United States Patent [19]

Ross

[11] Patent Number: 4,514,642

[45] Date of Patent: Apr. 30, 1985

[54] UNIT CONTROLLER FOR MULTIPLE-UNIT DISPATCH CONTROL

[75] Inventor: Charles W. Ross, Lansdale, Pa.

[73] Assignee: General Signal Corporation, Stamford, Conn.

[21] Appl. No.: 463,690

[22] Filed: Feb. 4, 1983

[51] Int. Cl.[3] ..... F01D 17/04; F01K 13/00

[52] U.S. Cl. ..... 290/40 R; 290/40 B; 290/40 A; 60/657; 60/646; 60/709

[58] Field of Search ..... 290/40, 40 A, 40 B, 290/40 C, 40 D, 40 E, 40 F, 40 R, 45, 51, 2, 4 R; 60/657, 646, 709

[56] References Cited

U.S. PATENT DOCUMENTS

| | | | |
|---|---|---|---|
| 2,861,196 | 11/1958 | Brownlee | 290/4 R X |
| 2,866,102 | 12/1958 | Cohn | 290/4 R X |
| 3,008,072 | 11/1961 | Jenkin, Jr. et al. | 318/28 |
| 3,238,376 | 3/1966 | Ernst et al. | 290/4 R |
| 3,417,737 | 12/1968 | Shinskey et al. | 290/2 X |
| 3,601,617 | 8/1971 | Mello | 290/40 C |
| 3,718,837 | 2/1973 | Yokota et al. | 290/2 X |
| 4,039,846 | 8/1977 | Vance | 290/40 R X |
| 4,081,956 | 4/1978 | Baker et al. | 290/40 R X |
| 4,114,084 | 9/1978 | Glaudel et al. | 290/40 R X |
| 4,120,159 | 10/1978 | Matsumoto et al. | 290/40 C X |
| 4,187,685 | 2/1980 | Tsuji et al. | 60/660 |
| 4,253,308 | 3/1981 | Eggenberger et al. | 60/680 X |
| 4,287,430 | 9/1981 | Guido | 290/40 C |
| 4,320,625 | 3/1982 | Westphal et al. | 60/646 |
| 4,357,803 | 11/1982 | Dickenson | 60/679 X |
| 4,412,422 | 11/1983 | Ross | 60/711 X |
| 4,445,045 | 4/1984 | Ross | 290/40 B |
| 4,482,814 | 11/1984 | Daniels | 290/40 B |

*Primary Examiner*—Vit W. Miska
*Assistant Examiner*—Paul Shik Luen Ip
*Attorney, Agent, or Firm*—W. G. Miller, Jr.; Harold Huberfeld

[57] ABSTRACT

A control system is provided for controlling the distribution of load among a plurality of generators with some of those generators responding quickly to control and some being slow in response. The area control error signal is divided into portions to provide a unit error signal assigned to each generator. A control is utilized which responds to the unit error signal to reposition the governor motor until the error signal is reduced to zero. Applying that control to slow responding units requires anticipation of the generation changes to be expected after full response. Control of the governor motor position so as to modify generation is from the unit error signal as modified in accordance with the difference between the desired generation for the units as required for economic considerations and the actual generation with that difference being modified by a signal which is a function of the anticipated generation. That function is expressable in one form by the equation $$P_{ai} = KP_{gi}\frac{\epsilon_{PT}}{P_T(SP)}$$

where:

K is a constant $P_{ai}$ is the anticipating signal $P_{gi}$ is the actual generation $\epsilon_{PT}$ is the deviation of the throttle pressure from its set point and $P_T(SP)$ is the throttle pressure set point and in another form by the equation $$P_{ai}=P_{gi}(SP)-P_{gi}.$$

10 Claims, 4 Drawing Figures

ACE
LOAD DISPATCHERS OFFICE
MC POSITION ALGORITHM
11
$P_1$
$P_2$
$P_i$
$P_{di}$ (EDC)
TO EDC
12
13
$\epsilon$
50
14
16
15
17
$\epsilon'$
52
$P_{ai}$
PULSE GEN.
18
TELEMETERING
20
62
68
64
$P_{gi}$
70
$P_{ai}$
72
$\epsilon$ MW
STATION
74
PID CONTROLLER
76
78
GOV. MOTOR
22
GOV. SERVO
24
66
26
BOILER AND COMBUSTION CONTROL
28
$P_1$
30
TURB.
44
GEN.
14
$P_{gi}$

UNIT CONTROLLER FOR MULTIPLE-UNIT DISPATCH CONTROL

BACKGROUND OF THE INVENTION

This invention relates to a means for controlling the generation of a plurality of electrical generating units such as those under regulation from a central power station. More particularly, this invention relates to a system for controlling units which have an inherently slow response when they are to be controlled with fast responding units. The slow units are, for example, the coal fired units which require pulverization of the coal before it is fed into the boiler. This type of unit is inherently slow in responding to control requiring a change in firing rate because of the slow rate of change at which the pulverizer will operate.

When units having a slow response are controlled by a control system which also controls fast responding units, it has been found that if the controller is tuned to have the proper characteristics for controlling the fast units, the slow units are improperly controlled. The improper control occurs due to the fact that the generating unit will respond quickly to the control signals related to the controlled variable (area control error) changing the manipulated variable (steam flow), but the change in firing rate which is necessary to support that change in flow at the proper steam pressure will not occur as quickly. Thus, there is a rapid increase in steam flow without a comparable change in fuel firing rate due to the slowness of the pulverizer. This causes the steam pressure of the unit to fall and the pressure control for the boiler to call for an increase in firing rate. The result is that the two controls (pressure and load) call for an increase in firing rate in such a way that the pressure control is likely to cycle as it fights the master controller which is controlling load in response to area control error (ACE). This is demonstrated by FIG. 1 in which a ramp change in megawatts output from a coal fired unit is shown to follow closely the response of the governor. As a result of the load change, the throttle pressure drops and as it recovers, in response to the pressure control increasing the fuel flow, the governor control and the pressure control start to fight each other and the result is a steady generator output with a cycling of the governor and pressure control.

In the past, control problems of this type have been solved by using process models to determine the expected generation change. That approach has only had limited success because of the great difficulty involved in providing an adequate model.

It is an object of this invention to provide a control system for load distribution control which will prevent such interaction.

SUMMARY OF THE INVENTION

Control systems for distributing the regulating burden of power systems among a plurality of generators present a problem when the generators being controlled have vastly different rates of response such as the difference between generators supplied from oil fired boilers as compared with the slower response times of generators supplied from coal fired boilers. When the regulation of both the fast and slow units is from a common control system utilizing an integrating control, with an integrating element responding to a unit error signal partitioned out of the total area control, problems arise with respect to the slow responding units in that the integrating element tends to wind up when the control of the firing rate in the boiler cannot follow the output of the integrating element. To correct this situation, an improvement in the unit controls for the slow responding unit is required. That improvement, in accordance with the present invention, utilizes a means responsive to a variable of the power system at the unit level for producing an anticipatory feedback signal which is indicative of the change in the unit that is expected to occur when the unit has responded fully to the integrating control. The anticipatory signal is introduced into the control system at a level in that system which is on the input side of the integrating element and so that the input to the integrating element is constrained to anticipate the response to the output of the integrating element which will occur under steady state conditions.

BRIEF DESCRIPTION OF THE DRAWINGS

In the figures, in which like reference characters refer to like elements.

DESCRIPTION OF THE PREFERRED EMBODIMENT

Figure 2:
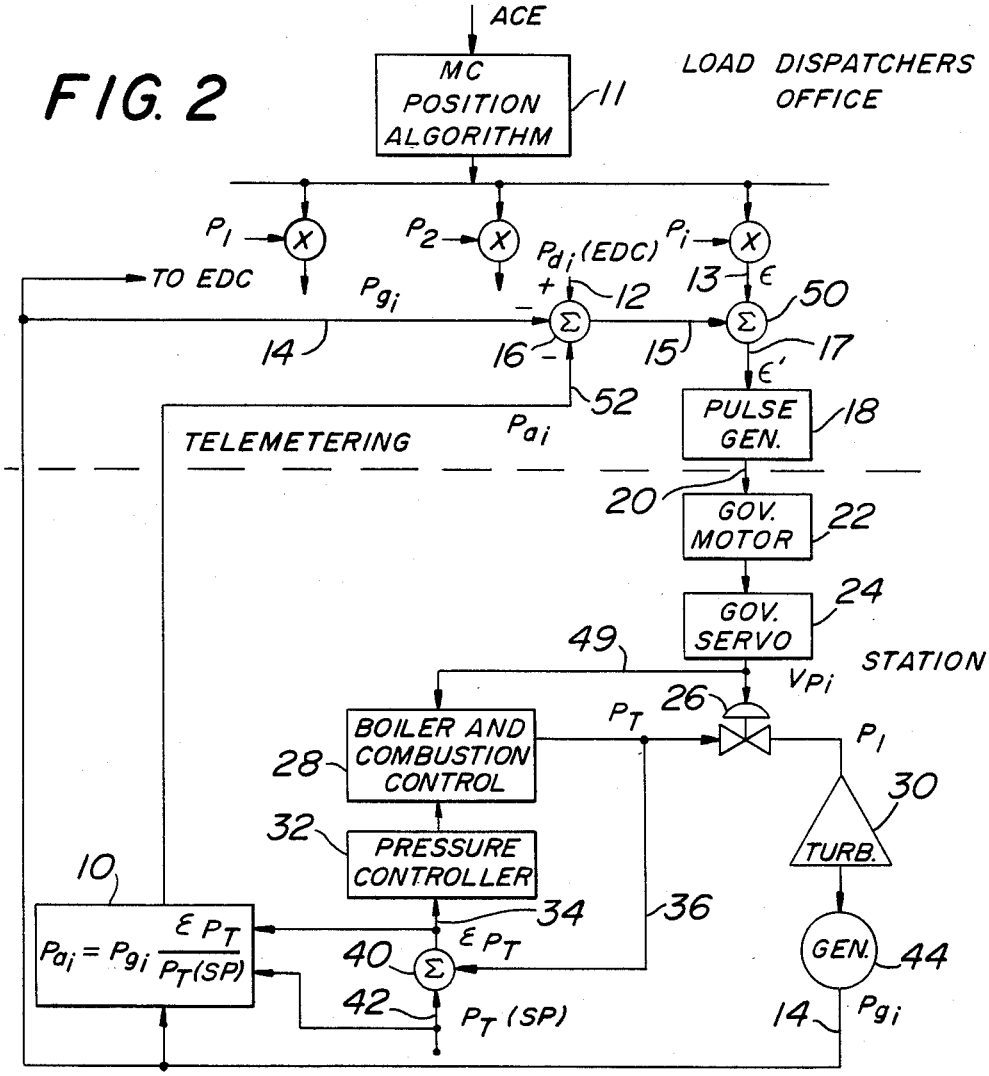
FIG. 2 is a block diagram of the circuit for the invention as it is applied in a mandatory control system.

In FIG. 2 there is shown a control system for a generating unit of an interconnected power system wherein the invention involves the generation of the signal $P_{ai}$ and its subtraction by way of summer 16 from the error signal $\epsilon$. Except for the subtraction of the signal $P_{ai}$ from the error signal after its computation in block 10, the system of FIG. 2 discloses a control system which is well known in the prior art. Particular reference should be had to U.S. Pat. No. 2,866,102, which is hereby incorporated as part of this specification, for a description of that prior art. In that patent there are described circuits useful in constructing a control system such as that shown in FIG. 2 as they were used in the prior art. As a matter of simplification and conformity with present operating procedures, the station and unit frequency biases are omitted in this description.

As is well known, a signal such as that on line 12 identified as $P_{di}$ (EDC) and representing the desired generation of the ith unit can be obtained by combining the area control error (ACE), sometimes referred to as Area Requirement, and the area generation, or Area Regulation, as determined for the particular area in which this unit is located. The sum of these two quantities represents the total area load and can be divided as desired among the units to be controlled in order to make an economic dispatch (EDC) of the load to the units in the area, $P_{di}$ (ECD). Likewise, the area control error may be used as an input to a master controller 11 which may utilize a position algorithm to determine an output signal representative of the total desired change in generation for the several units needed to provide regulation for the area. A portion $\rho_i$ of that desired generation change is the unit error signal $\epsilon$ on line 13. That error signal is then modified in accordance with the change in generation needed to fulfill the economic dispatch as altered by the control feedback representing anticipated changes in generation as determined from process variables $\epsilon_{PT}$ and $P_T$(SP).

In the prior art the signal representing the desired generation of the unit "i", $P_{di}$(EDC) is compared with the signal representing the actual generation of the unit, $P_{gi}$, as shown in FIG. 2. Thus the signal $P_{di}$(EDC) is compared with $P_{gi}$ in summer 16. The output of the summer 16 is then altered by $P_{ai}$ as supplied on line 52 which will be discussed later.

In the prior art the modified error signal $\epsilon'$ is introduced as an input to a unit controller, shown here as pulse generator 18. The output of the pulse generator is a pulse duration or a string of pulses whose duration is normally directly proportional to the error signal and which, as suggested in the prior art, can include a reset factor. Those pulses which appear on line 20 are telemetered to the station from the load dispatcher's office and serve to operate the governor motor 22 which works in combination with governor servo 24 to determine the position $V_{pi}$ of the throttle valve 26 which controls the flow of steam from the boiler 28 to the turbine 30 and hence the output of generator 44.

As indicated in the drawing of FIG. 2, the steam is supplied at a throttle pressure $P_T$ controlled by the pressure controller 32 in response to the error signal appearing on line 34. That error signal is determined by comparing the throttle pessure $P_T$ which appears as an input on line 36 to the summer 40 with the set point for the throttle pressure $P_T$(SP). The set point appears as a signal on line 42. The pressure controller 32 operates as part of the combustion control which controls the inputs to boiler 28, such as fuel, to maintain control of the pressure to the valve 26.

Figure 1:
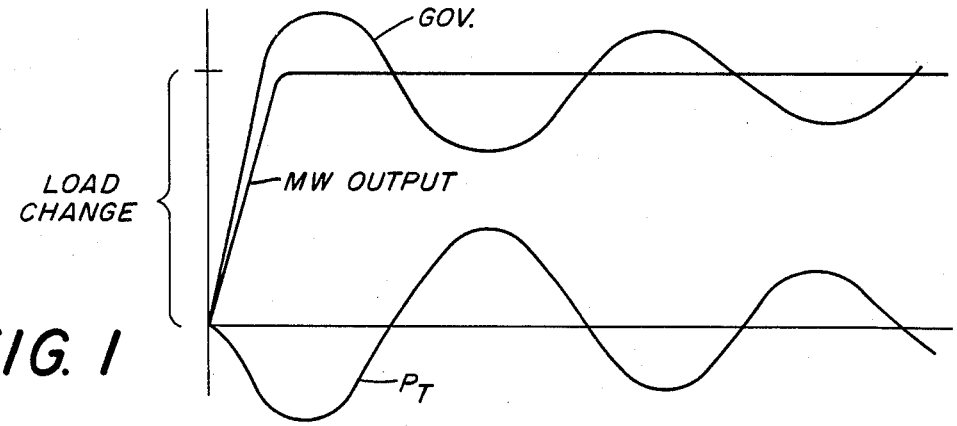
FIG. 1 is a graphic representation of the problem solved by the invention.

As had been pointed out previously, where the boiler combustion control system 28 has a slow response to load changes, and where the response of the governor motor 22 and the governor servo 24 are relatively rapid, then there can be an interaction between the pressure control by controller 32 and the load control supplied from the unit controller 18. The interaction can cause oscillation as shown in FIG. 1. In order to avoid the oscillations, it is useful to introduce into the summer 16 not only the signals $P_{di}$(EDC) and $P_{gi}$ but also the signal $P_{ai}$ which appears on line 52 as an anticipating signal computed by block 10 in response to the signal on line 14. This anticipating signal can be expressed in one form as the product of the actual generation and the normalized throttle pressure error as set forth by the equation $$P_{ai} = KP_{gi}\frac{\epsilon_{PT}}{P_T(SP)}$$

where $\epsilon_{PT}$ is the deviation of the throttle pressure, $P_T$, from its set point, $P_T$(SP). The effect of this anticipating signal is to supply on line 52, in response to a change in generation, $P_{gi}$, a signal which will anticipate the generation change which will take place as the throttle pressure returns to its set point $P_T$(SP). Thus, $P_{ai}$ modifies the feedback signal $P_{gi}$ in anticipation of changes in $P_{gi}$ which will occur when the generator responds fully to changes in $\epsilon$. By subtracting the output 15 of summer 16 from the error signal $\epsilon$ at summer 50, the modified error $\epsilon'$ is obtained on line 17 and the control system anticipates the change in generation which will normally occur due to response of the boiler control.

For a ramp change in the desired generation $P_{di}$, (EDC) or the error $\epsilon$, the quick response of the governor to pulses generated by 18 will cause a change in the output of generator 44 which will only represent a part of the change which will ultimately occur when the combustion control system for the boiler 28, in conjunction with the pressure control, has managed to increase the fuel input to the boiler so as to return the pressure $P_T$ to its desired value following the load change. That part of the change as reflected on line 14 to summer 16 may not be enough to counteract the change in $P_{di}$ (EDC) or the error $\epsilon$ when the amount of change in the position of governor motor 22 is that which will eventually be adequate in the steady state to accommodate the changes. Thus, the error $\epsilon'$ may have been reduced to zero by control action even though the further changes in the position of the valve 26 by that control action were not, in the long run, needed. This factor is, however, compensated by the signal supplied by block 10, which supplies in response to the pressure deviation from set point, a signal $P_{ai}$.

The system described above is, of course, a mandatory control system in that, upon a change in the error signal there is a corresponding change in the position of the governor motor and hence in the output of the generator. This type of a control system contrasts, of course, with a permissive control system wherein a control of the governor motor is executed only when the error signal at the unit level, such as on line 15, is of the same polarity as the area control error (ACE), as calculated for the area. This will be further explained in connection with FIG. 3.

Figure 3:
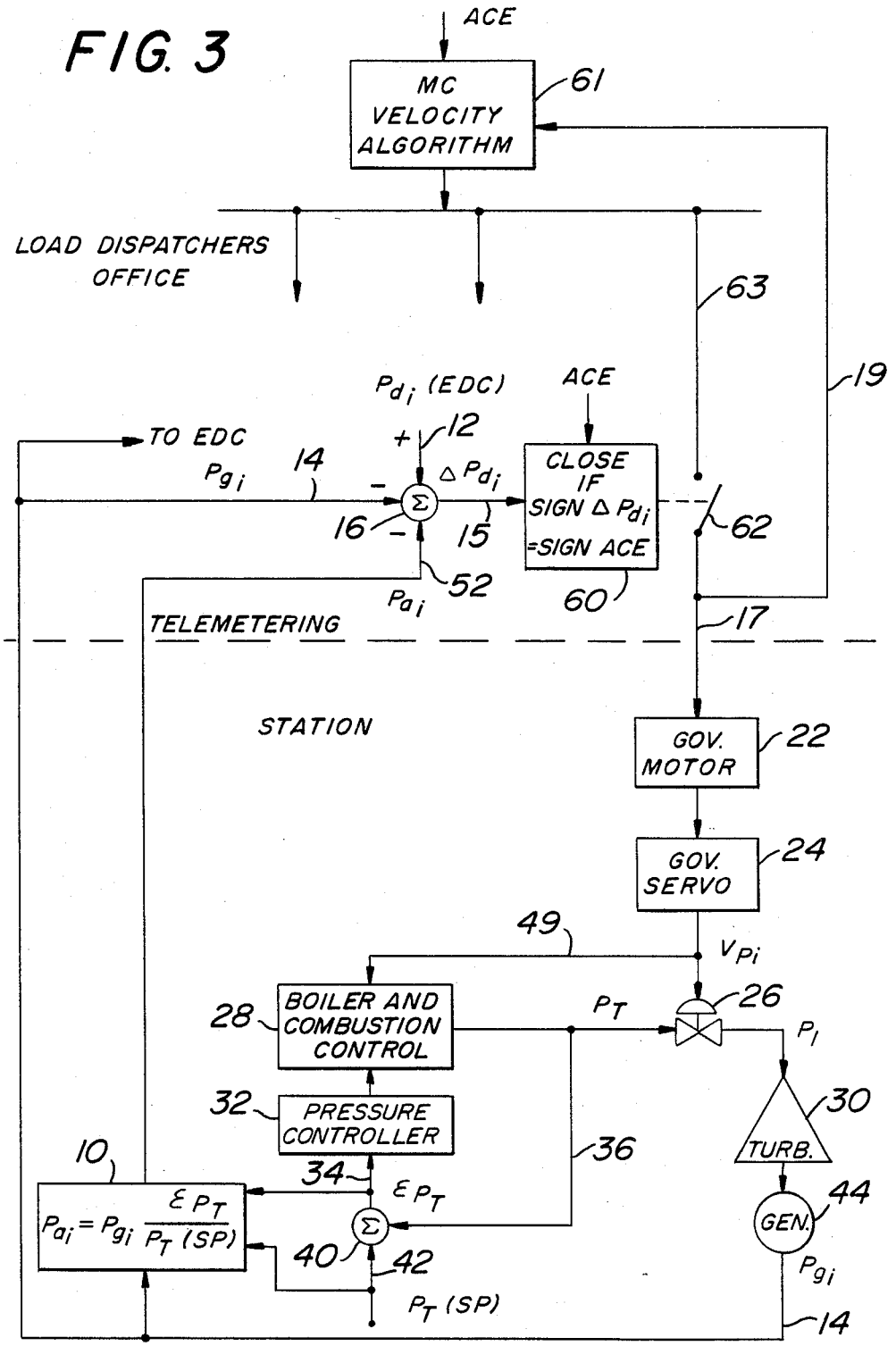
FIG. 3 is a block diagram of the invention as it is applied to permissive control of the units.

In FIG. 3 there is shown a permissive control system utilizing the invention. The master controller 61 has a velocity algorithm and produces pulses which are sent over line 63 to the control system for unit "i". The pulse signal on line 63 is of a magnitude required to apportion the total error ACE to the unit "i". The pulses are then filtered by the relay 62 which is operated by the operator 60 which in turn responds to the signal $\Delta P_{di}$ on line 15. The response of the relay operator is such that the relay is closed if the sign of $\Delta P_{di}$ is the same as the sign of ACE. In other words, when the change in generation needed to fulfill the calculated desired generation value $P_{di}$ (EDC) is of the same sense as the Area Control Error, ACE, the relay contact 62 is closed and control is effected.

A feedback from line 17 to controller 61 is provided by line 19 which makes it possible for the controller 61 to know whether or not the relay contact 62 is closed or not and hence the controller 61 will be aware of the amount of control action being effected. For the system of FIG. 3, the controller 61 can be a unit such as that described in U.S. Pat. No. 3,008,072, for example.

Figure 4:
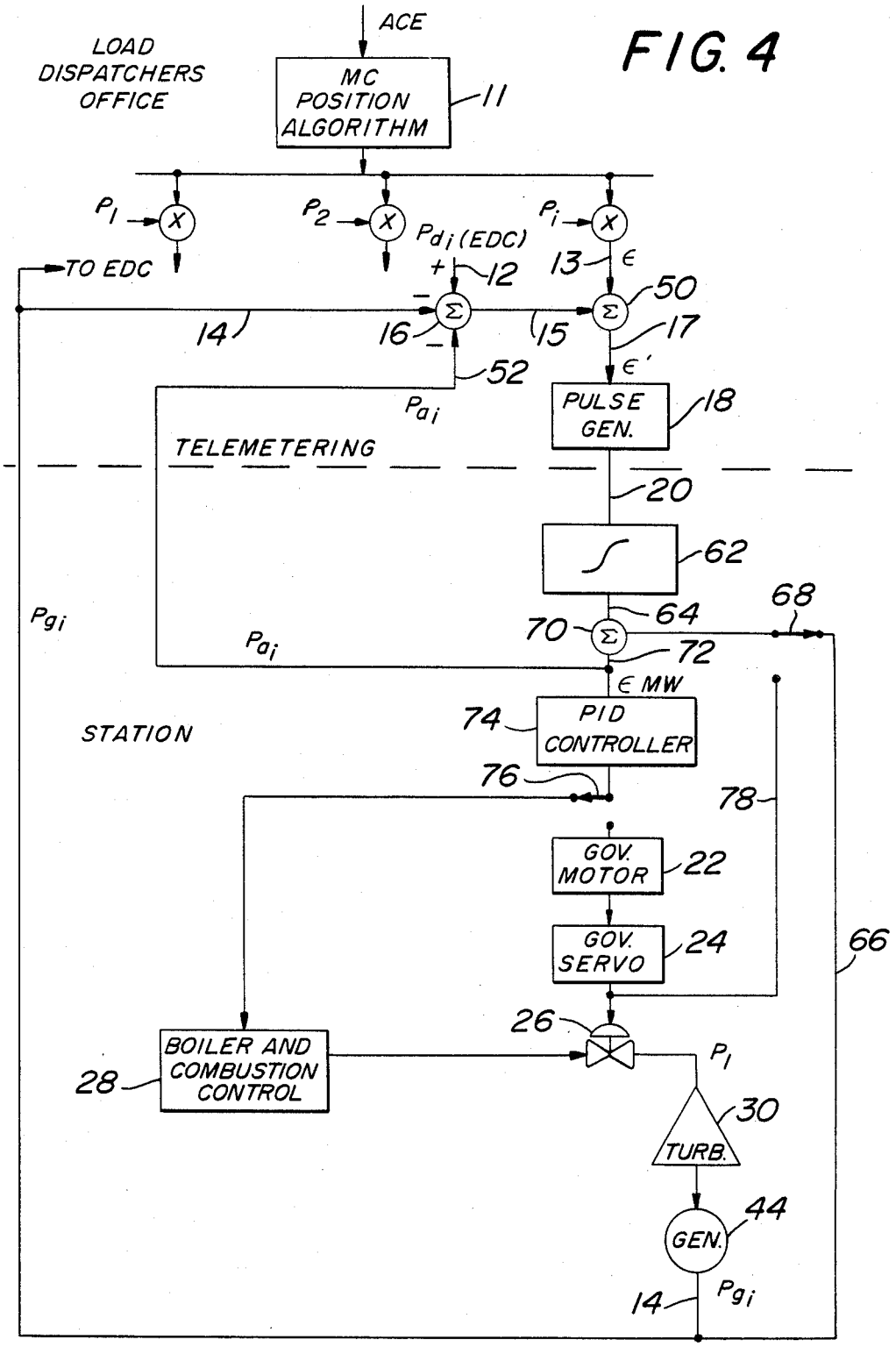
FIG. 4 is a block diagram of a mandatory control system which is different from the mandatory control system in FIG. 2.

In FIG. 4 there is shown a mandatory control system which utilizes the invention and which is different from the mandatory control system of FIG. 2. In the control system of FIG. 2, the integrating element is the governor motor 22. In FIG. 4, the integrating element is integrator 62 which receives as its input the pulses generated on line 20 by pulse generator 18 and which therefore produces on its output line 64 a signal which is the set point $P_{gi}$(SP) to which the controls for the unit must operate.

A feedback signal on line 66 indicative of the actual generation of generator 44 can be utilized with the switch 68 in the position shown to provide the signal with which the set point is compared by the summer 70 to produce on line 72 an error signal $\epsilon_{mw}$ indicating the deviation of the output of generator 44 from its desired set point value.

A PID controller 74 is utilized to provide a control signal to the boiler combustion control 28 for control of the firing of the boiler when the switch 76 is in the position shown. The switch 76 will normally be in the position shown in FIG. 4 when the boiler turbine system of the unit is operated in a turbine following mode. Otherwise the switch 76 will be connected to supply control signals to the governor motor 22 with a pressure control (not shown) controlling the boiler input.

A selection of control feedbacks may be made by changing the position of switch 68 so as to provide a signal related to the position of valve 26 as a feedback over line 78. This feedback is supplied in place of the actual generation feedback signal on line 66 when it is desired to have close control of valve position rather than actual generation.

In FIG. 4 the anticipating signal $P_{ai}$ is supplied over line 52 which in FIG. 4 is connected to line 72 so that the signal $P_{ai}$ is the same as the unit generation control error, $\epsilon_{mw}$. In other words, the error signal at the unit level is the variable of the power system required for producing a satisfactory anticipatory feedback signal in accordance with this invention. The suitability of the error signal on line 72 as an anticipatory feedback will be understood when one remembers that the error signal is indicative of the control which must still be accomplished at the unit level in order to fulfill the unit's assigned role in regulating the power system.

A permissive execution of the anticipatory control shown in FIG. 4 can be executed by substituting the anticipatory signal on line 72 (FIG. 4) for the signal on line 52 (FIG. 3).

In FIGS. 2 and 3, the normalized pressure deviation is used as an indication of the changes in generation which are still necessary in order to meet the regulating demand.

What is claimed is:

1. In a control system for distributing the regulating burden of a power system among a plurality of generators when said plurality of generators includes both fast and slow responding units and control of the regulation is carried out with an integrating unit control having an integrating element responding to a unit error signal which represents a predetermined part of the area control error, the improvement in each of the unit controls for the slow responding unit comprising:

means responsive to a variable of the power system at the unit level for producing an anticipatory feedback signal indicative of the change in generation of the unit that will occur when the unit has responded fully to the integrating control to reduce the unit error signal toward zero; and means for introducing said anticipatory signal into the control system on the input side of the integrating element to provide the anticipatory response required to prevent improper control action.

2. The control system of claim 1 in which said variable of the power system is the normalized throttle pressure error.

3. The control system of claim 1 in which said variable of the power system is the unit generation control error.

4. The control system of claim 1 in which said means for introducing said anticipatory signal into the control system includes the combination of the anticipatory signal with a signal representative of the actual generation to provide a modified feedback for the unit control.

5. A control system as set forth in claim 4 in which said means responsive to a variable of the system at the unit level for producing an anticipatory feedback signal is responsive to the actual generation.

6. A control system as set forth in claim 4 in which said means responsive to a variable of the system at the unit level for producing an anticipatory feedback signal is responsive to the governor valve position.

7. A control system for distributing the regulating burden of a power system among a plurality of generators driven by boiler-turbine units at a controlled throttle pressure when said plurality includes both fast and slow responding units and the regulation is carried out with an integrating control responding to a unit error signal representing a part of the area control error for the plurality of units, comprising:

a source of first signals representative of the desired generation established for each of the units in accordance with an economic division of the total load in the area supplied by said plurality of generators;

means for providing a second signal for each of said plurality of generators which is indicative of the output of the generators;

means for producing for each slow responding generator of said plurality a third signal which is a function of the turbine throttle pressure, the throttle pressure set point, and the actual generation such that it represents the change in generation anticipated when the throttle pressure returns to its set point;

means for producing a unit error signal representing a predetermined fraction of an area control error, said fraction representing the unit's share in the regulation of the area;

control means for controlling governor motor position, said means responding to the unit error with said response being modified in accordance with a signal which is calculated as the difference between the first and second signals minus the third signal so that the control anticipates the generation changes which will occur as throttle pressure changes to meet its set point.

8. A control system as set forth in claim 7 in which the response of the control means is modified by changing the unit error signal in accordance with the signal calculated as the difference between the first and second signals minus the third signal.

9. A control system as set forth in claim 7 in which the response of the control means to the unit error signal is allowed when the unit error signal is of the same sign as the signal calculated as the difference between the first and second signals minus the third signal.

10. A control system for controlling by the adjustment of governor motor position the distribution of load among a plurality of generators being driven by a boiler-turbine system at a controlled throttle pressure to be regulated, said plurality including both fast and slow responding units, comprising:

a source of first signals representative of the desired generation established for each of the units in accordance with an economic division of the total load in the area supplied by said plurality of generators;

means for providing a second signal for each of said plurality of generators which is indicative of the output of the generators;

means for producing for each slow responding generator of said plurality a third signal which is a function of a quantity indicative of the actual generation, said function being expressable by the equation $$P_{ai} = KP_{gi}\frac{\epsilon_{PT}}{P_T(SP)};$$

where

K is a constant $P_{ai}$ is the third signal, $P_{gi}$ is the actual generation, $\epsilon_{PT}$ is the deviation between the throttle pressure and its set point, and $P_T(SP)$ is that set point;

means for producing a unit error signal representing a predetermined fraction of an area control error, said fraction representing the unit's share in the regulation of the area;

means for modifying said unit error signal in accordance with the difference between the first and second signals plus the third signal; and control means for adjusting the output of the unit, said control means responding to the unit error signal as modified for changing the generation of said units to provide an economic dispatch of the load and assistance in its regulation.

* * * * *